US006935266B2

(12) United States Patent
Hahn et al.

(10) Patent No.: US 6,935,266 B2
(45) Date of Patent: Aug. 30, 2005

(54) BOAT WITH ENHANCED ACCESS TO ENGINE AND STERN

(75) Inventors: Tom Hahn, Sebeka, MN (US); Russ Kane, New York Mill, MN (US); Terry Weller, Perham, MN (US)

(73) Assignee: Lund Boat Company, Minneapolis, MN (US)

( * ) Notice: Subject to any disclaimer, the term of this patent is extended or adjusted under 35 U.S.C. 154(b) by 0 days.

(21) Appl. No.: 10/756,958

(22) Filed: Jan. 13, 2004

(65) Prior Publication Data

US 2004/0266282 A1 Dec. 30, 2004

Related U.S. Application Data

(60) Provisional application No. 60/482,893, filed on Jun. 25, 2003.

(51) Int. Cl.[7] ..... B63B 17/00
(52) U.S. Cl. ..... 114/363
(58) Field of Search ..... 114/363; 440/76, 440/77

(56) References Cited

U.S. PATENT DOCUMENTS 2,803,023 A * 8/1957 Rosenberg et al. ..... 441/127
3,823,431 A * 7/1974 Miller ..... 114/361
5,497,724 A * 3/1996 Brown et al. ..... 114/343
6,296,535 B1 10/2001 Bland et al.
6,302,053 B1 * 10/2001 Tomczak et al. ..... 114/363
6,350,165 B1 2/2002 Neisen
2002/0195041 A1 * 12/2002 Kalhok et al. ..... 114/361

OTHER PUBLICATIONS

Lund® Brochure, "A Tradition of Quality," pp. front & back cover, 1–58 (2002).

Crestliner® Brochure, "Boats—Whatever You Do On The Water, Do It In A Crestliner," pp. 1–44 (2002).

* cited by examiner

*Primary Examiner*—Ed Swinehart
(74) *Attorney, Agent, or Firm*—Malin, Haley & DiMaggio, P.A.

(57) ABSTRACT

A boat having an inboard/outboard drive unit is disclosed herein. The drive unit includes an engine covered by a hood. The hood is movable between an open position and a closed position. Seats are positioned on opposite sides of the hood. The seats are carried with the hood as the hood is moved between the open and closed positions. Seats that are moveable to enhance access to the stern are also disclosed.

15 Claims, 5 Drawing Sheets

BOAT WITH ENHANCED ACCESS TO ENGINE AND STERN

This patent application claims the benefit of provisional patent application Ser. No. 60/482,893, filed Jun. 25, 2003, which application is hereby incorporated by reference in its entirety.

TECHNICAL FIELD

The present invention relates generally to boats. More particularly, the present invention relates to boats with aft mounted drive units.

BACKGROUND

An inboard/outboard drive unit (i.e., a stern drive unit) for a boat typically includes an engine mounted within the hull of the boat. The engine is disposed at the keel line adjacent the stern of the boat. The drive unit also includes an outdrive that projects rearwardly from the transom of the boat. The outdrive is configured to transfer mechanical energy from the engine to a propeller. The outdrive is typically pivotally connected to the transom by a gimbal structure that allows the outdrive to pivot about a generally vertical steering axis and a generally horizontal tilt-trim axis. Examples of inboard/outboard drive units are disclosed in U.S. Pat. Nos. 6,296,535 and 6,350,165, that are hereby incorporated by reference in their entireties.

For maintenance and repair, it is sometimes necessary to access the engine of an inbound/outboard drive unit. The engine is commonly covered by a hood that can be pivoted open to expose the top side of the engine. However, even with the hood open, the sides of the engine are typically obstructed by seats mounted within the boat on opposite sides of the engine. Thus, access to the engine is encumbered. The seats also can prevent passengers from easily accessing the stern region of the boat.

SUMMARY

One inventive aspect of the present disclosure relates to a configuration for providing enhanced access to an aft mounted engine. In one non-limiting embodiment, the configuration includes seats that are movable so as to not interfere with lateral access to the engine.

Another inventive aspect of this disclosure relates to a boat having an engine mounted along a keel line of the boat. A hood covers the engine. A pocket is positioned between the hood and a side of the boat. A seat is positioned at the pocket. The seat includes a seat cushion and a back cushion. The seat cushion is movable between a first position where the seat cushion extends across the pocket, and a second position where the seat cushion is upright within the pocket and aligned along a plane that extends generally parallel to the keel line. When in the second position, a passenger can walk into the pocket to better access stern regions of the boat.

Examples of a variety of inventive aspects in addition to those described above are set forth in the description that follows. It is to be understood that both the forgoing general description and the following detailed description are exemplary and explanatory only and are not restrictive of the broad inventive aspects that underlie the examples disclosed herein.

DETAILED DESCRIPTION

Figure 1:
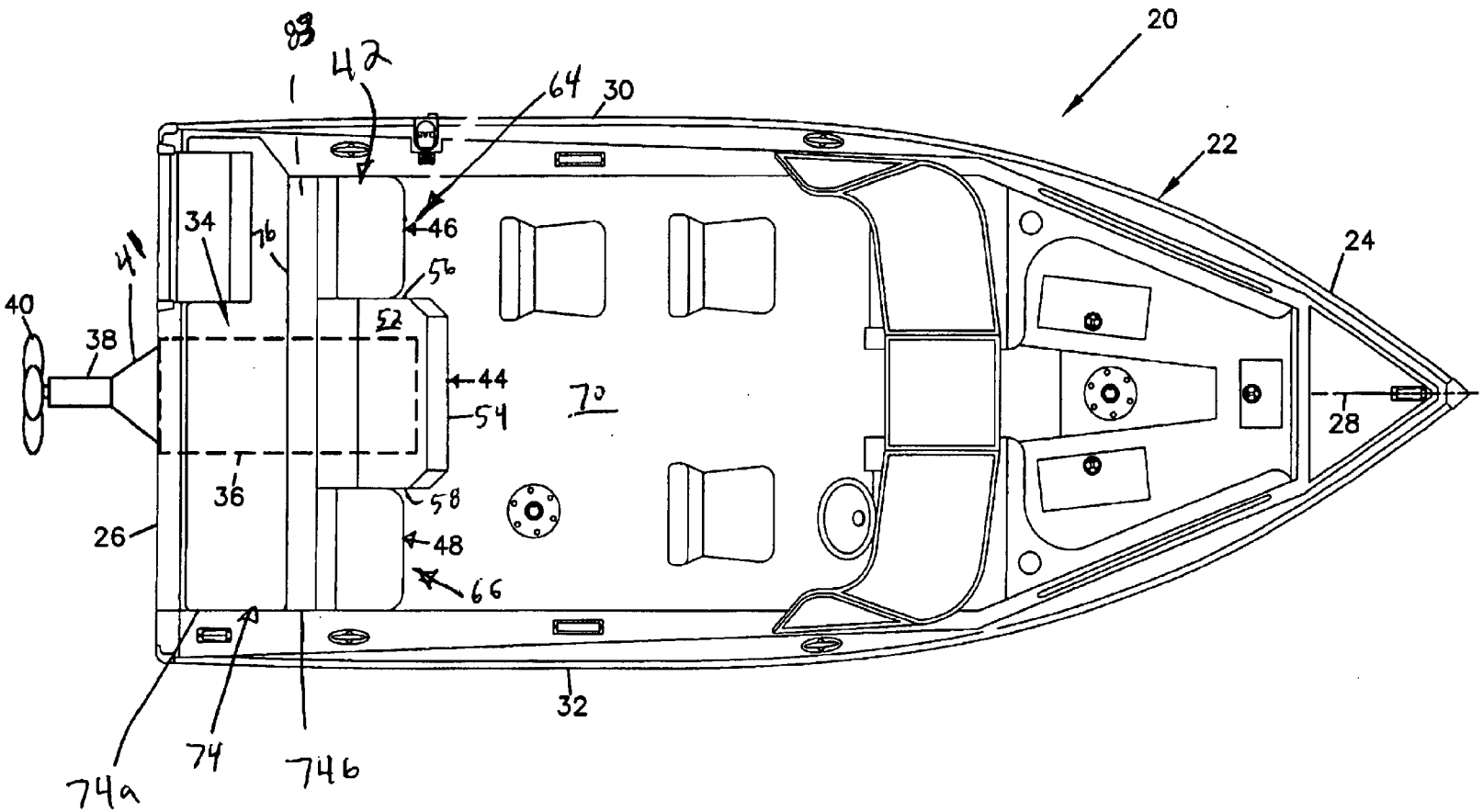
FIG. 1 is a top plan view of a boat having features that are examples of inventive aspects in accordance with the principles of the present disclosure.

Referring now to FIG. 1, an example boat 20 is shown. The boat 20 includes a hull 22 having a bow 24 and a stern 26. A keel line 28 of the hull 22 extends from the bow 24 to the stern 26. The hull 22 also includes port and starboard sides 30 and 32 that extend from the bow 24 to the stern 26. The boat 20 further includes a propulsion device in the form of an inboard/outboard drive unit 34. The inboard/outboard drive unit 34 includes an engine 36 (e.g., a diesel or gasoline engine) mounted within the hull 22 adjacent the stern 26. The engine 36 is centered generally along the keel line 28 of the boat. The inboard/outboard drive unit 34 also includes an outdrive 38 that projects outwardly from the stern 26. The outdrive 38 is pivotally connected to the transom of the hull 22 by a gimbal housing 41. A conventional gear and shaft arrangement is incorporated within the outdrive 38 for transferring torque from the engine 36 to a propeller 40. In other embodiments, an inboard drive unit can be used.

The boat 20 is equipped with a combined hood and seat unit 42 positioned at an aft region of the hull 22. The hood and seat unit 42 includes a central hood 44 that covers the engine 36. The hood 44 preferably includes insulation for damping engine noise and for preventing heat transfer through the hood 44. The hood and seat unit 42 also includes a port seat 46 positioned between the hood 44 and the port side 30 of the hull, and a starboard seat 48 positioned between the hood 44 and the starboard side 32 of the hull 22. The hood and seat unit 42 is movable between a closed position (shown in FIG. 2) and an open position (shown in FIG. 4). When the hood and seat unit 42 is moved from the closed position to the open position, the seats 46, 48, are carried along with the hood 44 such that the entire assembly moves as a single unit. In this manner, when the hood and seat unit 42 is in the open position of FIG. 4, the seats 46, 48 are displaced from alongside the engine 36 so as to provide improved access to the port and starboard sides of the engine. Structures such as lift cylinders 51 (e.g., conventional gas lift cylinders) can be used to hold the unit 42 in the open position.

Figure 3:
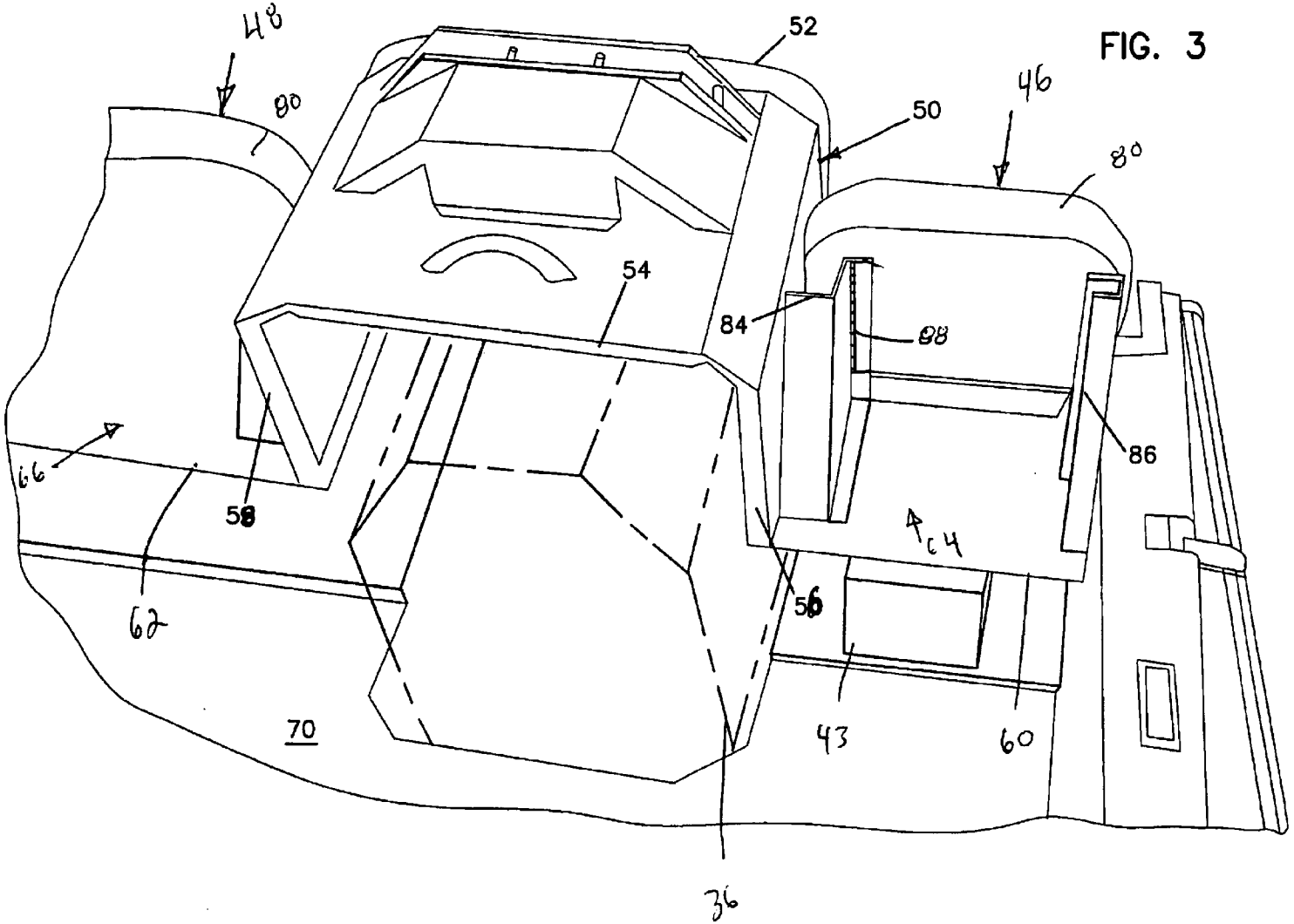
FIG. 3 shows the hood and seat unit of FIG. 2 in a partially opened position.

Referring to FIG. 3, the combined hood and seat unit 42 includes a frame 50. The frame 50 includes a plurality of walls that cooperate to define the hood 44. For example, the walls of the hood 44 include a top wall 52, a front wall 54, a port wall 56, and a starboard wall 58. The frame also includes a rear wall 60 that extends from the port wall 56 of the hood to adjacent the port side 32 of the hull 22, and a rear wall 62 that extends from the starboard wall 58 of the hood 44 to adjacent the starboard side 32 of the hull 22. The rear wall 60 is aligned generally perpendicular with respect to the port wall 56 of the hood 44, and the two walls cooperate to define a port seat pocket 64. Similarly, the rear wall 62 is aligned generally perpendicular with respect to the starboard wall 58 of the hood 44, and the two walls cooperate to define a starboard seat pocket 66. The port seat 46 is mounted at the port seat pocket 64, and the starboard seat 48 is mounted at the starboard seat pocket 66.

Figure 2:
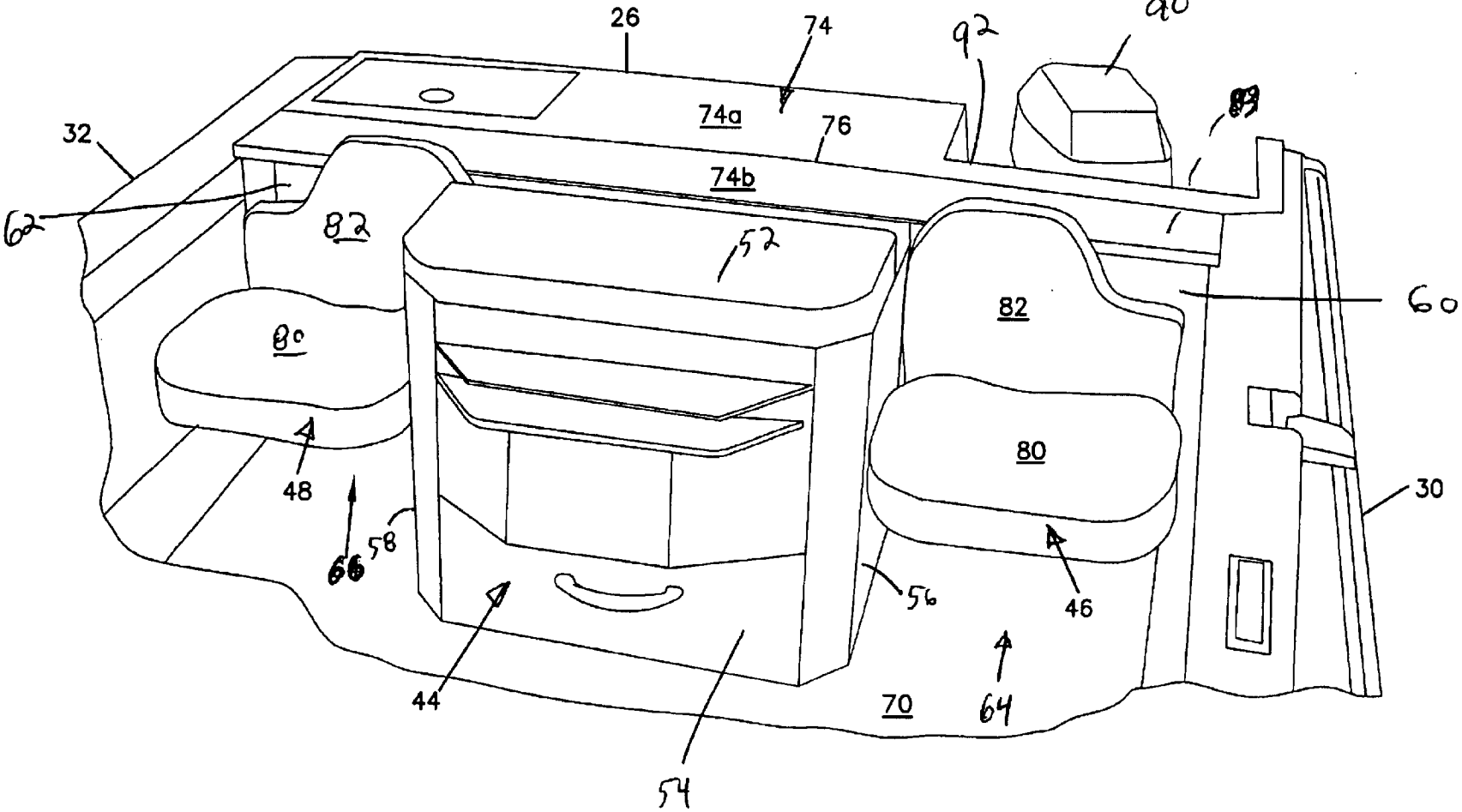
FIG. 2 is a perspective view of an aft region of the boat of FIG. 1, the aft region is shown including a combined hood and seat unit that is depicted in a closed position.
Figure 4:
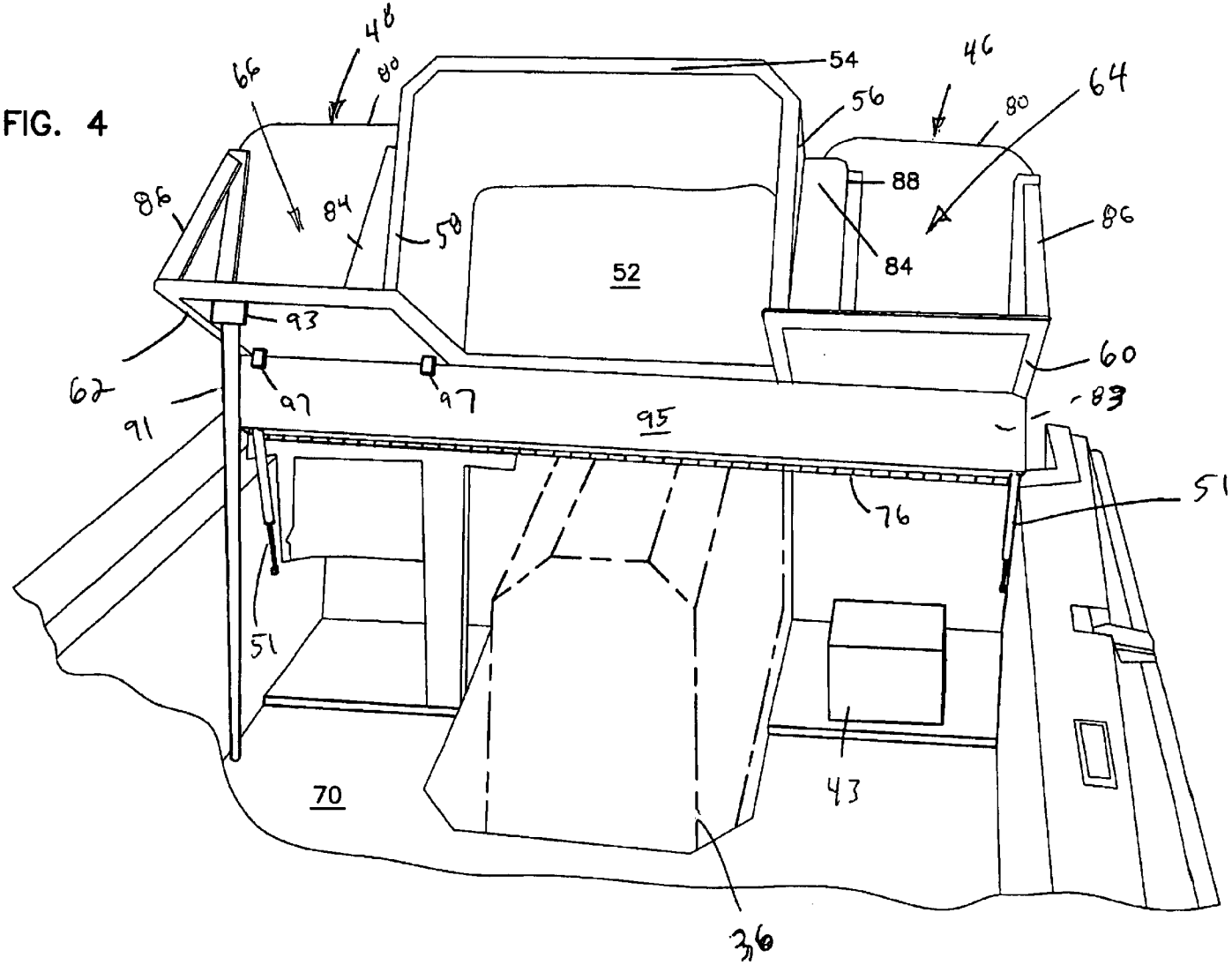
FIG. 4 shows the hood and seat unit of FIG. 2 in a fully opened position.

When the combined hood and seat unit 42 is in the closed (i.e., lowered) position of FIG. 2, the hood 44 covers the engine 36 and abuts a floor 70 of the boat. Also, when the hood and seat unit 42 is in the closed position, the rear walls 60, 62 extend from the floor 70 to a rear top deck 74 of the boat 20. Storage regions are located behind the walls 60, 62. As shown in FIG. 4, the storage regions can be accessed when the hood and seat unit 42 is pivoted to the open position. In FIG. 4, a battery 43 is shown stored in one of the storage regions.

The rear top deck 74 includes a rearward portion 74*a* and a forward extension 74*b*. A storage chamber 83 is preferably located below the forward extension 74*b*. A hinge structure 76 preferably having a double hinge construction allows the entire hood and seat unit 42 to be pivoted relative to the rearward deck portion 74*a* between the open and closed positions. The hinge structure 76 also allows the forward extension 74*b* to be pivoted between an open position where access is provided to the storage chamber 83, and a closed position where the storage chamber 83 is closed. The storage chamber 83 can be used to store items such as a boat canopy.

An extendable pole 91 for bracing the hood and seat unit 42 in the open position can be stored at the underside of a bottom wall 95 (see FIG. 4) of the storage chamber 83. Clips 97 can be used to secure the pole 91 to the wall 95. The pole 91 assists lift cylinders 51 to prevent the hood and seat unit from inadvertently closing. To use the pole 91, the pole 91 is removed from the wall 95 and inserted into a hole in a bracket 93 provided on the hood and seat unit 42 to prop to unit 42 in the open position (see FIG. 4).

As shown in FIG. 4, the lift cylinders 51 are located on opposite sides of the hood and seat unit 42. The lift cylinders 51 have upper ends pivotally connected to a rear wall of the storage chamber 83 and bottom ends pivotally connected to the interior side panels of the boat.

In the embodiment of FIGS. 1–4, the seats 46, 48 are carried along with the hood 44 when the hood is moved between the closed and open positions. The hood 44 and the seats 46, 48 preferably move about a common pivot axis defined by the hinge structure 76. In alternative embodiments, the seats 46, 48 can be movable independent of the hood 44 so as to be moved to positions where the port and starboard sides of the engine 36 are not obstructed. In still other embodiments, the seats 46, 48 can have separate pivot axes from the hood 44.

Referring again to FIG. 2, each of the seats 46, 48 includes a seat cushion 80 and a back cushion 82. The seat cushions 80 are supported by inner supports 84 and outer supports 86 (see FIG. 4). The inner supports 84 are coupled to the port and starboard walls 56, 58 of the hood 44 and to inner regions of the rear walls 60, 62. The outer supports 86 are connected to outer regions of the rear walls 60, 62. The back cushions 82 are also coupled to the rear walls 60, 62.

Figure 5:
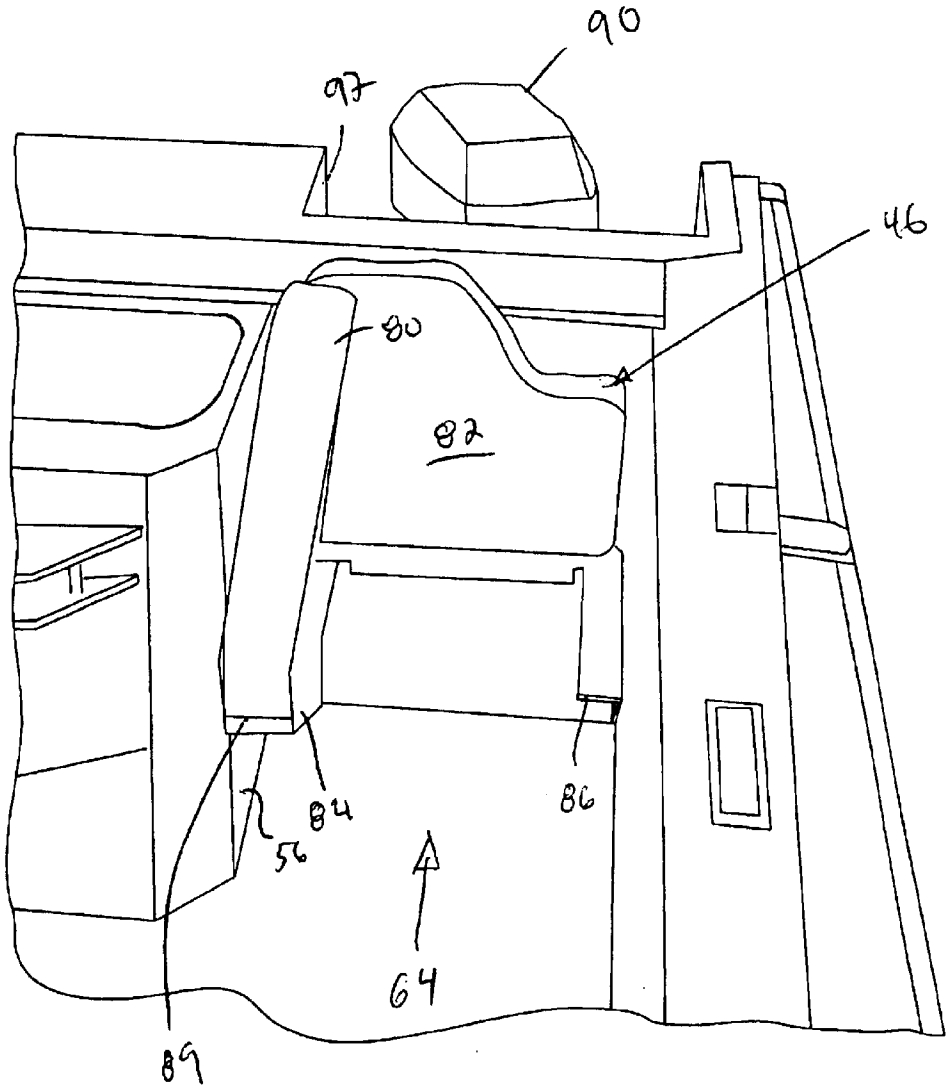
FIG. 5 shows the combined hood and seat unit of FIG. 2 with the seat cushions of one of the seats pivoted to an upright position in which a passenger can readily walk into a pocket region previously occupied by the seat cushion.

Referring to FIG. 3, the seat cushions 80 are pivotally connected to the inner supports 84 by hinges 88 (only the hinge 88 for seat 46 is shown). The hinges have pivot axes that are generally parallel to the keel line 28 of the boat 20 when the hood and seat unit 42 is in the closed position. The hinges 88 allow the seat cushions 80 to be pivoted between first positions where the seat cushions 80 extend across the seat pockets 64, 66 (see FIG. 2), and second positions where the seat cushions 80 are upright and generally parallel to the port and starboard walls 56, 58 of the hood 44 (see FIG. 5 where only the cushion 80 of seat 46 is shown). When the seat cushions 80 are in the lowered position of FIG. 2, outer regions of the cushions 80 rest upon the outer supports 86 and the cushions 80 are adapted to be sat upon. When the cushions 80 are in the raised position of FIG. 5, the cushions 80 are generally upright so as to not block access to the seat pockets 64, 66. Thus, with the seat cushions 80 in the upright positions, a passenger can walk along the floor into the seat pockets without interference from the seat cushions 80.

Access to the seat pockets 64, 66 is advantageous for a number of reasons. For example, by entering the seat pocket 66, a passenger is in closer proximity to an auxiliary motor 90 positioned in an auxiliary motor pocket 92 of the boat 20. Also, when trolling, access to the seat pockets 64, 66 allows a passenger to walk in closer proximity to fishing rods mounted within holders located at the stern of the boat 20.

When the seat cushions 80 are in the upright positions, portions of the cushions are trapped in regions 89 between upright portions of the inner supports 84 and the sidewalls 56, 58 of the hood 44 so as to be conveniently stored at a non-obstructive location. In other embodiments, the hinged connection between the inner supports 84 and seat cushions 80 can be eliminated. In such embodiments, the seat cushions 80 can be lifted from the supports 84, 86 and stored in upright configurations within the regions 89 defined by the inner supports 84. In other embodiments, a fastening structure such as Velcro could be used to hold the cushions 80 in place.

The pockets 64, 66 have closed back ends defined by the rear walls 60, 62, and open front ends positioned opposite the closed ends. The pockets also include first and second opposing sides that extend between the front and back ends. In the depicted embodiment, portions of the first and second sides are defined by the inner and outer supports 84, 86. When the seat cushions 80 are down, the cushions 80 extend across the pockets 64, 66 so as to traverse a distance between the sides of the pockets 64, 66. When the seat cushions 80 are up, the cushions 86 extend along one of the sides of the pockets (e.g., along one of the sides of the hood).

As used herein, the term "hood" can also be referred to as a cover, box, insulator or shield. Also, the term "wall" can also be referred to as a panel, member, structure or divider. Moreover, the frame can also be referred to as a structure or assembly. Furthermore, the term "pocket" can be referred to as a recess, nook, region or cavity.

With regard to the forgoing description, it is to be understood that changes may be made in detail, especially with respect to the shape, size and arrangement of the parts. It is intended that the specification and depicted aspects be considered illustrative only and not limiting with respect to the broad underlying concepts of the present disclosure.

We claim:

1. A boat comprising:

a hull having a bow, a stern a port side and a starboard side;

an engine positioned at the stern of the hull;

a hood for covering the engine, the hood being moveable between a closed position where the engine is covered and an open position where the engine can be accessed; and a first seat positioned between the engine and one of the port and starboard sides of the hull, the seat being independently moveable from said hood relative to the engine between a lowered position and raised position; and a hinge for allowing the seat to be pivoted from the lowered position to the raised position;

wherein lateral access to the engine is not blocked when the first seat is in the raised position.

2. The boat of claim 1, wherein the seat is coupled to the hood such that the seat moves from the lowered position to the raised position when the hood is moved from the closed position to the open position.

3. The boat of claim 1, wherein the hood pivots about a first pivot axis when moved between the closed position and the open position, and wherein the seat pivots about the first pivot axis when moved between the lowered position and the raised position.

4. The boat of claim 3, wherein the seat pivots in concert with the hood such that the seat and the hood pivot as a unit.

5. The boat of claim 1, further comprising a second seat positioned between the engine and the other of the port and starboard sides of the hull, the second seat being moveable relative to the engine between a lowered position where the second seat is adapted to be sat upon and a raised position where the second seat does not block lateral access to the engine.

6. A boat comprising:

a hull having a bow, a stern a port side and a starboard side;

an inboard/outboard drive unit including an engine positioned at the stern of the hull;

a combined hood and seat unit that is moveable between a closed position where the engine is covered and an open position where the engine can be accessed, the combined hood and seat unit including:

a frame defining a hood for covering the engine, the hood including a hood top wall, a hood port wall, a hood starboard wall and a hood front wall, the frame also including a first rear wall that extends from the hood port wall toward the port side of the hull and a second rear wall that extends from the hood starboard wall toward the starboard side of the hull, the first rear wall and the hood port wall cooperating to define a first seat pocket, and the second rear wall and the hood starboard wall cooperating to define a second seat pocket;

a first seat coupled to the frame and positioned at the first seat pocket;

a second seat coupled to the frame and positioned at the second seat pocket; first hinge means for allowing the combined seat and hood unit to be pivoted between the open and closed positions; and second hinge means for said first and said second seats, said seats being independently moveable from said hood.

7. The boat of claim 6, wherein the boat includes a rear top deck, wherein the hinge connects the combined seat and hood unit to the top deck, and wherein the hinge extends across a width of the boat.

8. The boat of claim 7, wherein when the first and second rear walls extend from a floor of the boat to the rear top deck when the combined hood and seat unit is in the closed position.

9. The boat of claim 6, wherein the first and second seats each include a back cushion and sea seat cushion, the back cushions of the first and second seats being respectively coupled to the first and second seats being respectively coupled to the hood port wall and the hood starboard wall.

10. The boat of claim 9, wherein the seat cushion of the first seat pivots relative to the hood port wall between a first position where the seat cushion is adapted to be sat upon and a second position where the seat cushion is generally parallel relative to the hood port wall, and wherein the seat cushion of the second seat pivots relative to the hood starboard wall between a first position where the seat cushion is adapted to be sat upon and a second position where the seat cushion is generally parallel relative to the hood starboard wall.

11. A boat comprising:

a hull having a bow, a stern a port side and a starboard side;

an engine positioned at the stem of the hull;

a hood for covering the engine;

a pocket positioned between the hood and one of the port and starboard sides of the hull; and a seat positioned at the pocket, the seat including a seat cushion that is moveable between a first position where the seat cushion extends across the pocket and is adapted to be sat upon, and a second position where the seat cushion is located upright within the pocket and is aligned along a plane that extends generally parallel to a keel line of the boat, wherein a passenger can walk into the pocket when the seat cushion is in the second position; and a hinge for allowing the seat cushion to pivot between the first and second positions.

12. The boat of claim 11, wherein the hinge is positioned adjacent to the hood.

13. A boat comprising:

a hull having a bow, a stem a port side and a starboard side;

an engine positioned at the stern of the hull;

a hood for covering the engine;

a pocket positioned between the hood and one of the port and starboard sides of the hull, the pocket having a closed back end and an open front end, the pocket also including first and second sides that extend between the front and back ends; and a seat positioned at the pocket, the seat including a seat cushion and a back cushion, the back cushion being positioned at the closed back end of the pocket, the seat cushion being moveable between a first position where the seat cushion extends across the pocket between the first and second sides of the pocket and is adapted to be sat upon, and a second position where the seat cushion is located upright within the pocket and is aligned along one of the first and second sides of the pocket, wherein a passenger can walk into the pocket when the seat cushion is in the second position;

and comprising a hinge for allowing the seat cushion to pivot between the first and second positions.

14. The boat of claim 13, wherein the first side of the pocket is defined by a sidewall of the hood and the second side of the pocket is defined by an interior sidewall of the boat.

15. The boat of claim 14, wherein the seat cushion is positioned adjacent to the first side of the pocket when in the second position.

* * * * *